US012618132B2

(12) United States Patent
Takeda et al.

(10) Patent No.: US 12,618,132 B2
(45) Date of Patent: May 5, 2026

(54) METHOD FOR MANUFACTURING HOT-DIP GALVANIZED STEEL SHEET

(71) Applicant: JFE Steel Corporation, Tokyo (JP)

(72) Inventors: Gentaro Takeda, Tokyo (JP); Hideyuki Takahashi, Tokyo (JP); Mai Aoyama, Tokyo (JP); Maiko Watanabe, Tokyo (JP); Tatsuya Ehashi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 18/577,328

(22) PCT Filed: Jun. 9, 2022

(86) PCT No.: PCT/JP2022/023212
§ 371 (c)(1),
(2) Date: Jan. 8, 2024

(87) PCT Pub. No.: WO2023/286501
PCT Pub. Date: Jan. 19, 2023

(65) Prior Publication Data

US 2024/0318290 A1 Sep. 26, 2024

(30) Foreign Application Priority Data

Jul. 14, 2021 (JP) ..... 2021-116033

(51) Int. Cl.
*C23C 2/02* (2006.01)
*C22C 38/00* (2006.01)
(Continued)

(52) U.S. Cl.
CPC ..... *C23C 2/0224* (2022.08); *C22C 38/002* (2013.01); *C22C 38/02* (2013.01);
(Continued)

(58) Field of Classification Search
CPC .... C23C 2/02; C23C 2/06; C23C 2/40; C23C 38/00; C23C 38/02; C23C 38/04;
(Continued)

(56) References Cited

U.S. PATENT DOCUMENTS 8,592,049 B2 * 11/2013 Honda ..... C21D 9/46 428/641
12,031,192 B2 * 7/2024 Takeda ..... C23C 2/28
(Continued)

FOREIGN PATENT DOCUMENTS

CN 104838034 A 8/2015
CN 110358993 A 10/2019
(Continued)

OTHER PUBLICATIONS

International Search Report and Written Opinion for International Application No. PCT/JP2022/023212, dated Aug. 16, 2022, 7 pages.
(Continued)

*Primary Examiner* — Brian K Talbot
(74) *Attorney, Agent, or Firm* — Buchanan Ingersoll & Rooney PC

(57) ABSTRACT

When a hot-dip galvanizing treatment is performed on a steel sheet containing Si in an amount of 0.2 mass % or more by using a continuous hot-dip galvanizing apparatus including an annealing furnace in which a heating zone, a soaking zone, and a cooling zone are arranged in this order, a snout adjacent to the cooling zone, and hot-dip galvanizing equipment, a humidified nitrogen-hydrogen gas mixture containing moisture in such a manner that a certain expression is satisfied is supplied into a region on the downstream side of the soaking zone, gas nozzles are arranged over the entire perimeter of an inner wall of the snout, nitrogen gas or a nitrogen-hydrogen gas mixture is supplied through the gas
(Continued)

nozzles downward along the inner wall, and the dew point in the snout is controlled to be −50° C. to −35° C.

2 Claims, 4 Drawing Sheets

(51) Int. Cl.

| | |
|---|---|
| ***C22C 38/02*** | (2006.01) |
| ***C22C 38/04*** | (2006.01) |
| ***C23C 2/00*** | (2006.01) |
| ***C23C 2/28*** | (2006.01) |
| ***C23C 2/40*** | (2006.01) |

(52) U.S. Cl.
CPC ..... *C22C 38/04* (2013.01); *C23C 2/004* (2022.08); *C23C 2/285* (2013.01); *C23C 2/40* (2013.01)

(58) Field of Classification Search
CPC .. C21D 9/46; C21D 9/56; C22C 38/00; C22C 38/02; C22C 38/04
USPC ..... 427/319, 321
See application file for complete search history.

(56) References Cited

U.S. PATENT DOCUMENTS

| | | | | |
|---|---|---|---|---|
| 2009/0123651 | A1* | 5/2009 | Okada | C23C 2/06 427/319 |
| 2014/0251505 | A1* | 9/2014 | Blumenau | C23C 2/0224 148/287 |
| 2014/0350746 | A1* | 11/2014 | Lee | G05D 23/19 700/300 |
| 2015/0140218 | A1* | 5/2015 | Takahashi | F27D 7/06 266/44 |
| 2015/0167113 | A1* | 6/2015 | Takahashi | C21D 1/26 148/533 |
| 2015/0167138 | A1* | 6/2015 | Schaffrath | C23C 2/40 118/68 |
| 2015/0361520 | A1* | 12/2015 | Takahashi | C21D 9/005 266/111 |
| 2015/0361521 | A1* | 12/2015 | Takahashi | C21D 9/56 266/111 |
| 2016/0363372 | A1* | 12/2016 | Takeda | C23C 2/0224 |
| 2017/0130296 | A1* | 5/2017 | Takeda | C23C 2/0224 |
| 2018/0051356 | A1* | 2/2018 | Takeda | C23C 2/004 |
| 2018/0105916 | A1* | 4/2018 | Takahashi | C23C 2/0035 |
| 2018/0237896 | A1* | 8/2018 | Takeda | C23C 2/0222 |
| 2018/0347018 | A1 | 12/2018 | Schulz et al. | |
| 2019/0276913 | A1* | 9/2019 | Kwak | C21D 9/561 |
| 2020/0190652 | A1* | 6/2020 | Takeda | C21D 9/573 |
| 2020/0377964 | A1* | 12/2020 | Takeda | C21D 9/573 |

FOREIGN PATENT DOCUMENTS

| | | | |
|---|---|---|---|
| CN | 110520552 | A | 11/2019 |
| CN | 111235509 | A | 6/2020 |
| CN | 111690805 | A | 9/2020 |
| EP | 2 927 342 | A1 | 10/2015 |
| EP | 2 857 532 | B1 | 7/2016 |
| EP | 3 617 339 | A1 | 3/2020 |
| JP | 2006111893 | A | 4/2006 |
| JP | 2009209397 | A | 9/2009 |
| JP | 2013095952 | A | 5/2013 |
| JP | 2017082278 | A | 5/2017 |
| JP | 2018188717 | A | 11/2018 |
| JP | 2019189894 | A * | 10/2019 |
| WO | 2007043273 | A1 | 4/2007 |
| WO | 2016170720 | A1 | 10/2016 |

OTHER PUBLICATIONS

The extended European Search Report issued Feb. 8, 2024, by the European Patent Office in corresponding European Patent Application No. 22841845.5-1103. (9 pages).

Office Action (Notice of Reasons for Refusal) issued Jul. 4, 2023, by the Japan Patent Office in corresponding Japanese Patent Application No. 2022-550138 and an English translation of the Office Action. (10 pages).

Office Action (The First Office Action) issued Dec. 27, 2025, by the State Intellectual Property Office of People's Republic of China in corresponding Chinese Patent Application No. 202280048626.2 and an English translation with Concise explanation of relevance of the Office Action. (18 pages).

Office Action (Request for the Submission of an Opinion) issued Jan. 8, 2026, by the Korean Intellectual Property Office in corresponding Korean Patent Application No. 10-2024-7000709 and an English translation with the Concise Statement of Relevance of the Office Action. (10 pages).

* cited by examiner

METHOD FOR MANUFACTURING HOT-DIP GALVANIZED STEEL SHEET

CROSS REFERENCE TO RELATED APPLICATIONS

This is the U.S. National Phase application of PCT/JP2022/023212, filed Jun. 9, 2022, which claims priority to Japanese Patent Application No. 2021-116033, filed Jul. 14, 2021, the disclosures of these applications being incorporated herein by reference in their entireties for all purposes.

FIELD OF THE INVENTION

The present invention relates to a method for manufacturing a hot-dip galvanized steel sheet by using a continuous hot-dip galvanizing apparatus including an annealing furnace in which a heating zone, a soaking zone, and a cooling zone are arranged in this order, a snout adjacent to the cooling zone, and hot-dip galvanizing equipment.

BACKGROUND OF THE INVENTION

Nowadays, in the fields of, for example, automobiles, home electric appliances, and building materials, there is an increasing demand for a high-strength steel sheet (high-tensile strength steel material) which can be used for, for example, reducing the weight of structures. As examples of a high-tensile strength steel material, it is known that a steel sheet having good stretch flangeability can be obtained by adding Si to steel, and a steel sheet having good ductility can be obtained by adding Si, Al, and Mn to steel so that retained y tends to be formed.

However, in the case where a hot-dip galvanized steel sheet is manufactured by using a high-strength steel sheet containing Si or Mn in a large amount (in particular, 0.2 mass % or more) as a base material, since Si or Mn in steel, which is an easily oxidizable element, is selectively oxidized even in a reducing atmosphere or a non-oxidizing atmosphere, which is used generally, Si or Mn is concentrated on the surface of the steel sheet to form oxides. Since such oxides cause a deterioration in wettability with molten zinc when a coating treatment is performed, bare spots occur. Therefore, there is a sharp deterioration in wettability due to an increase in the concentration of Si or Mn in steel, which results in frequent bare spot occurrence. In addition, even in the case where a bare spot does not occur, there is a problem of a deterioration in coating adhesiveness. Moreover, in the case where a hot-dip galvannealed steel sheet is manufactured, when Si or Mn in steel is selectively oxidized and concentrated on the surface of the steel sheet, since alloying is markedly delayed in an alloying process, which is performed after a hot-dip galvanizing process, there is also a problem of a marked deterioration in productivity.

In response to such problems, Patent Literature 1 discloses a technique for inhibiting Si from being concentrated on the surface of a steel sheet by performing annealing to promote internal oxidation of Si in a continuous annealing and hot-dip coating method utilizing an annealing furnace having an anterior part of a heating zone, a posterior part of the heating zone, a heat-retaining zone, and a cooling zone in this order and a hot-dip coating bath, in which heating or heat-retaining is performed on the steel sheet at least in a steel sheet temperature range of 300° C. or higher by using an indirect heating method, in which the furnace atmosphere in each of the zones contains hydrogen in an amount of 1 volume % to 10 volume % and a balance of nitrogen and incidental impurities, in which the maximum end-point temperature of the steel sheet in the anterior part of the heating zone is 550° C. or higher and 750° C. or lower, in which the dew point of the anterior part of the heating zone is lower than-25° C., in which the dew point of the posterior part of the heating zone and the heat-retaining zone is −30° C. or higher and 0° C. or lower, and in which the dew point of the cooling zone is lower than −25° C. In addition, Patent Literature 1 also states that a humidified gas mixture of nitrogen and hydrogen is supplied into the posterior part of the heating zone and/or the heat-retaining zone.

Patent Literature 2 discloses a technique for inhibiting Si from being concentrated on the surface of a steel sheet by measuring the dew point of the furnace gas of a reducing furnace and changing the supply and exhaust positions of the furnace gas in accordance with the measurement results so that the dew point of the furnace gas is higher than −30° C. and 0° C. or lower. Patent Literature 2 states that, although any one of a DFF (direct-fired furnace), a NOF (nonoxidizing furnace), and a radiant tube-type furnace may be used as a heating furnace, it is preferable that a radiant tube-type furnace be used because this markedly realizes the effects according to aspects of the invention.

Patent Literature 3 discloses a method for achieving good slidability as a result of achieving uniform coating weight by controlling the dew point of an atmosphere gas in a snout to be within a predetermined range (preferably, −50° C. or lower) in accordance with the chemical composition of steel (the contents of Si and Al).

Patent Literature 4 discloses a method for manufacturing a steel sheet having good appearance without a bare spot by dehumidifying an atmosphere gas in a region from a heating zone to a soaking zone with a refiner (dehumidifying device) disposed on the outside of the furnace so that the dew point of the atmosphere gas is −50° C. or lower and by supplying a humidified gas into a snout region so that the dew point of the atmosphere gas in the snout is −35° C. to −10° C.

PATENT LITERATURE

PTL 1: International Publication No. 2007-043273

PTL 2: Japanese Unexamined Patent Application Publication No. 2009-209397

PTL 3: Japanese Unexamined Patent Application Publication No. 2006-111893

PTL 4: Japanese Unexamined Patent Application Publication No. 2013-095952

SUMMARY OF THE INVENTION

However, in the case of the method according to Patent Literature 1, it was found that, since only the representative dew point of each of the heating zone to the cooling zone is controlled, the adjustment of the amount of water supplied in accordance with changes in product size and sheet passing speed is delayed, and the measured dew point is different from that in the vicinity of the steel sheet containing large amounts of added elements such as Si and the like, which tends to absorb a large amount of water, for some period even when the measured dew point is within the appropriate range, resulting in bare spot occurrence due to an appropriate amount of water not being supplied. In addition, depending on the condition of the dew point of the snout, there is a problem of bare spot occurrence even in the case where the dew points of the heating zone and the soaking zone are stable.

In the case of the method according to Patent Literature 2, the surface of the steel sheet may be oxidized when a direct-fired furnace is used as a heating furnace, and, since a humidified gas is not actively supplied into the annealing furnace, it is difficult to stably control the dew point within the higher range of the controlling range, that is, a range of −20° C. to 0° C. In addition, since the dew point of the upper part of the furnace tends to be higher in the case where the dew point is increased, there may be a case where the dew point of the atmosphere of the upper part of the furnace is +10° C. or higher when a dew point meter in the lower part of the furnace shows a dew point of 0° C. Therefore, it was found that, if the operation is continued for a long time under such a condition, a pickup defect occurs in upper hearth rolls.

In the case of the method according to Patent Literature 3, since a bare spot frequently occurs with only the control of the dew point of the snout, and since zinc fume (ash) defects frequently occur due to the dew point of the snout being decreased to be −50° C. or lower, it is not possible to manufacture a galvanized steel sheet having a good aesthetic appearance.

In the case of the method according to Patent Literature 4, although an ash defect is unlikely to occur due to oxide films of Zn and Al being formed on the liquid surface of the galvanizing bath in the snout by controlling the dew point of the snout to be −35° C. to −10° C., it was found that, even though the dew point in the annealing furnace is controlled to be −50° C. or lower, bare spot defects occur since small amounts of surface oxides of Si, Mn, and Al formed on the surface of the steel sheet entrain the oxide films of Zn and Al when entering the coating bath.

Therefore, in view of the problems described above, an object according to aspects of the present invention is to provide a method for manufacturing a hot-dip galvanized steel sheet with which it is possible to achieve high coating adhesiveness and good coating appearance, even in the case where a hot-dip galvanizing treatment or a hot-dip galvannealing treatment is performed on a steel sheet containing Si in an amount of 0.2 mass % or more.

In accordance with aspects of the present invention, the term "hot-dip galvanized steel sheet" may be used as a generic term to refer to a steel sheet which is not subjected to an alloying treatment after a hot-dip galvanizing treatment has been performed and to a steel sheet which is subjected to an alloying treatment after a hot-dip galvanizing treatment has been performed.

To solve the problems described above, the present inventors diligently conducted investigations regarding a method for manufacturing a hot-dip galvanized steel sheet with which it is possible to achieve high coating adhesiveness and good coating appearance, even in the case where a hot-dip galvanizing treatment or a hot-dip galvannealing treatment is performed on a steel sheet containing Si in an amount of 0.2 mass % or more.

First, on the basis of the idea that it is effective to promote internal oxidation of added elements such as Si and the like in a soaking zone so that such elements are not concentrated on the surface of a steel sheet, it was inferred that it is effective to control the amount of moisture in an atmosphere in a region on the downstream side of a soaking zone, which is considered to determine the surface quality of the steel sheet to be galvanized, under specified conditions. On the basis of such inference, investigations were conducted on the relationship of the amount of moisture with coating adhesiveness and coating appearance. As a result, it was found that it is possible to achieve high coating adhesiveness and good coating appearance by controlling the ratio between an index (X) indicating the influence of the surface area of a steel sheet and the amount of moisture (M) contained in a humidified gas which is supplied into a soaking zone to be within a specified range and by controlling the dew point in a snout to be within a specified range.

Here, when the interior of the soaking zone is divided into two regions in the horizontal longitudinal direction of equipment, that is, the upstream side on which a steel sheet enters and the downstream side on which the steel sheet exits, the expression "region on the downstream side of a soaking zone" denotes a region on the downstream side. The upstream side and the downstream side do not necessarily have completely the same length, and the term "downstream side" denotes 60% to 40% of the horizontal equipment length of the interior of the soaking zone.

In addition, it is necessary that a pressing flaw be inhibited as much as possible to achieve good coating appearance, and the present inventors found that it is necessary that the flow condition of an atmosphere gas in a snout be optimized to inhibit a pressing flaw. For this purpose, the present inventors found that it is effective to dispose gas nozzles over the entire perimeter of the inner wall of a snout, supply nitrogen gas or a nitrogen-hydrogen gas mixture through the gas nozzles downward along the inner wall, and discharge a specified portion or more of the supplied gas through an exhaust port disposed in the upper part of the snout.

Aspects of the present invention have been completed on the basis of the knowledge described above, and a summary of aspects of the present invention is as follows.

[1] A method for manufacturing a hot-dip galvanized steel sheet, the method including performing a hot-dip galvanizing treatment on a steel sheet containing Si in an amount of 0.2 mass % or more by using a continuous hot-dip galvanizing apparatus including an annealing furnace in which a heating zone, a soaking zone, and a cooling zone are arranged in this order, a snout adjacent to the cooling zone, and hot-dip galvanizing equipment, in which a humidified nitrogen-hydrogen gas mixture containing moisture in such a manner that expression (1) below is satisfied is supplied into a region on the downstream side of the soaking zone, in which gas nozzles are arranged over the entire perimeter of an inner wall of the snout, in which nitrogen gas or a nitrogen-hydrogen gas mixture is supplied through the gas nozzles downward along the inner wall, in which at least two exhaust ports are disposed in an upper part of the snout to discharge the gas that is supplied through the gas nozzles, and in which the dew point in the snout is controlled to be −50° C. to −35° C.:

$$158 < M/X < 178 \quad (1)$$

where M denotes the amount of moisture contained in the humidified gas that is supplied into the soaking zone and X denotes a parameter regarding an influence of a surface area of the steel sheet.

[2] The method for manufacturing a hot-dip galvanized steel sheet according to item [1], in which M and X satisfy equations (2) and (3) below.

$$M = 0.08074 \times Vh \times 10^{7.5Th/(Th+237.3)} \quad (2)$$

-continued $$X = 0.2 \times w \times S + 0.4935 \quad (3)$$

M: amount of moisture contained in the humidified gas that is supplied into the soaking zone (g/min)

X: parameter regarding an influence of the surface area of the steel sheet

Vh: flow rate of the humidified gas that is supplied into the soaking zone ($Nm^3/hr$)

Th: dew point of the humidified gas that is supplied into the soaking zone (° C.)

w: width of the steel sheet (m)

S: sheet passing speed (m/s)

[3] The method for manufacturing a hot-dip galvanized steel sheet according to item [1] or [2], in which 70 volume % or more of the amount of the gas that is supplied through the gas nozzles is discharged through the exhaust ports in the upper part of the snout.

According to the method for manufacturing a hot-dip galvanized steel sheet according to aspects of the present invention, it is possible to manufacture a steel sheet with high coating adhesiveness and good coating appearance, even in the case where a hot-dip galvanizing treatment is performed on a steel sheet containing Si in an amount of 0.2 mass % or more.

DETAILED DESCRIPTION OF EMBODIMENTS OF THE INVENTION

Figure 1:
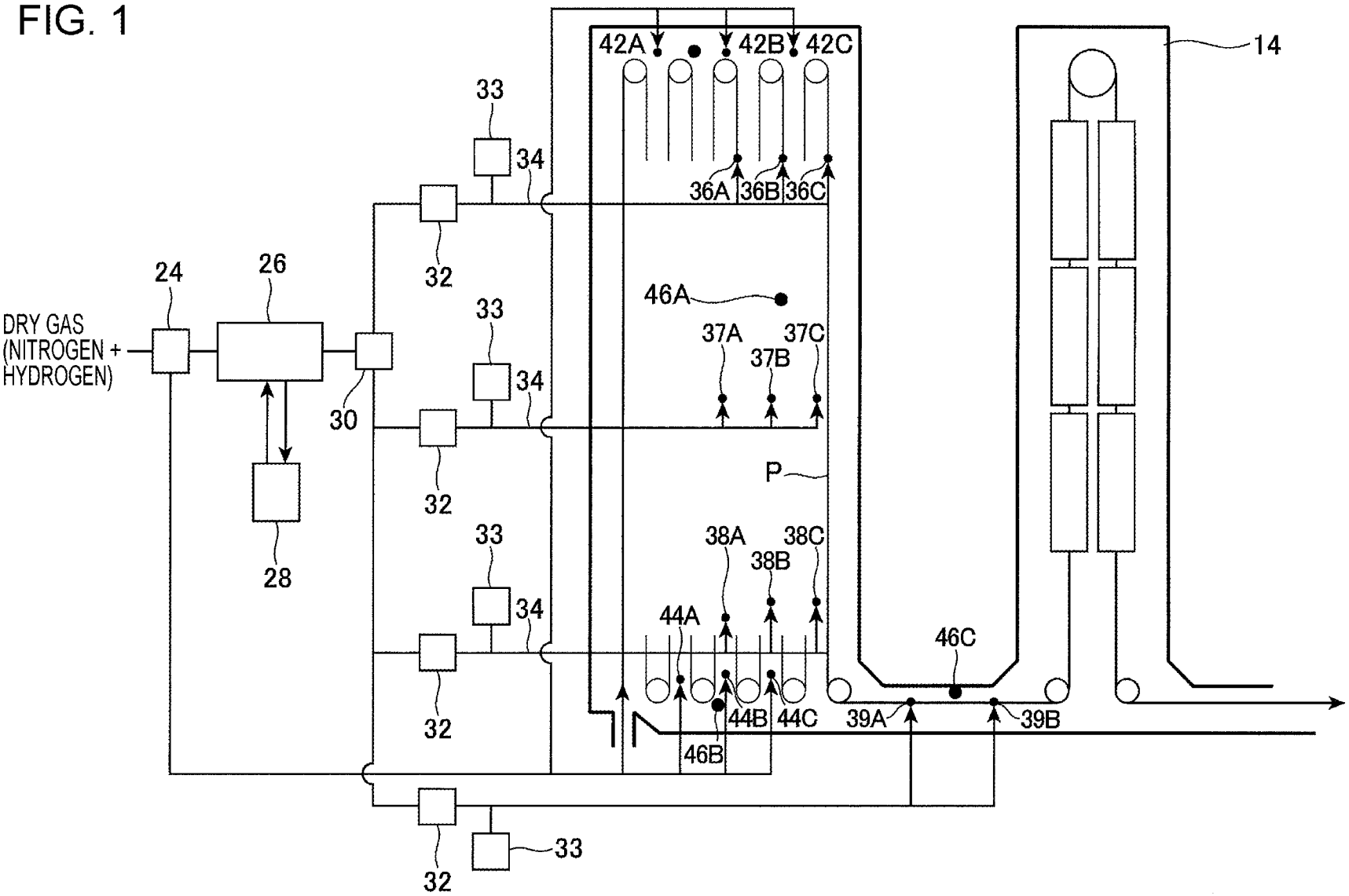
FIG. 1 is a diagram illustrating one embodiment of a supply route of a furnace gas in a soaking zone.

First, the constitution of a continuous hot-dip galvanizing apparatus which is used in a method for manufacturing a hot-dip galvannealed steel sheet according to one embodiment of the present invention will be described with reference to FIG. 3. The continuous hot-dip galvanizing apparatus includes an annealing furnace in which a heating zone 10, a soaking zone 12, and cooling zones 14 and 16 are arranged in this order and hot-dip galvanizing equipment adjacent to the cooling zone 16, that is, a hot-dip galvanizing bath 22. The heating zone 10 in the present embodiment includes a first heating zone 10A (anterior part of the heating zone, not illustrated) and a second heating zone 10B (posterior part of the heating zone, not illustrated). The cooling zone includes a first cooling zone 14 (rapid cooling zone) and a second cooling zone 16 (gradual cooling zone). The front end of a snout 18 connected to the second cooling zone 16 is immersed in the hot-dip galvanizing bath 22, and the annealing furnace and the hot-dip galvanizing bath 22 are connected through the snout 18. The continuous hot-dip galvanizing apparatus also includes alloying equipment 23 which is used for heating and alloying a galvanizing layer.

(Heating Zone)

In the heating zone in the present embodiment, it is possible to indirectly heat a steel sheet P by using a radiant tube or an electric heater. It is preferable that the average temperature of the interior of the heating zone be 500° C. to 800° C. While a gas from the soaking zone flows into the heating zone, a reducing gas or a non-oxidizing gas is separately supplied into the heating zone. Typical examples of the reducing gas used include a nitrogen-hydrogen gas mixture such as a gas having a chemical composition containing hydrogen in an amount of 1 volume % to 20 volume % and a balance of nitrogen and incidental impurities (having a dew point of about-60° C.). In addition, examples of the non-oxidizing gas include a gas having a chemical composition containing nitrogen and incidental impurities (having a dew point of about-60° C.).

(Soaking Zone)

In the soaking zone 12 in the present embodiment, it is possible to indirectly heat the steel sheet P by using a radiant tube (RT, not illustrated) as heating means. It is preferable that the average temperature of the interior of the soaking zone 12 be 700° C. to 900° C.

A reducing gas or a non-oxidizing gas is supplied into the soaking zone 12. Typical examples of the reducing gas used include a gas mixture of nitrogen and hydrogen (hereinafter, also referred to as "nitrogen-hydrogen gas mixture") such as a gas having a chemical composition containing hydrogen in an amount of 1 volume % to 20 volume % and a balance of nitrogen and incidental impurities (having a dew point of about −60° C.). In addition, examples of the non-oxidizing gas include a gas having a chemical composition containing nitrogen and incidental impurities (having a dew point of about −60° C.).

In the present embodiment, the reducing gas or the non-oxidizing gas which is supplied into the soaking zone 12 is used in two forms, that is, in the form of a humidified gas and in the form of a dry gas. Here, the term "dry gas" denotes a reducing gas or non-oxidizing gas described above having a dew point of about −60° C. to −50° C. which is not humidified by using a humidifying device. On the other hand, the term "humidified gas" denotes a gas which is humidified by using a humidifying device so as to have a dew point of 0° C. to 30° C. When a high-strength steel sheet containing Si or the like is manufactured, by supplying a humidified gas to increase the dew point in a furnace, internal oxidation of Si or the like is promoted, thereby performing control so that Si or the like is not concentrated on the surface of the steel sheet.

The amount of the humidified gas which flows into a region on the downstream side of the soaking zone is adjusted so that expression (1) below is satisfied.

$$158 < M/X < 178 \quad (1)$$

Here, M denotes the amount of moisture contained in the humidified gas that is supplied into the soaking zone and X denotes a parameter regarding an influence of a surface area of the steel sheet. More specifically, M and X are values which satisfy equations (2) and (3) below.

$$M = 0.08074 \times Vh \times 10^{7.5Th/(Th+237.3)} \quad (2)$$

$$X = 0.2 \times w \times S + 0.4935 \quad (3)$$

M: amount of moisture contained in the humidified gas that is supplied into the soaking zone (g/min)

X: parameter regarding an influence of the surface area of the steel sheet

Vh: flow rate of the humidified gas that is supplied into the soaking zone ($Nm^3/hr$)

Th: dew point of the humidified gas that is supplied into the soaking zone (° C.)

w: width of the steel sheet (m)

S: sheet passing speed (m/s)

Figure 4:
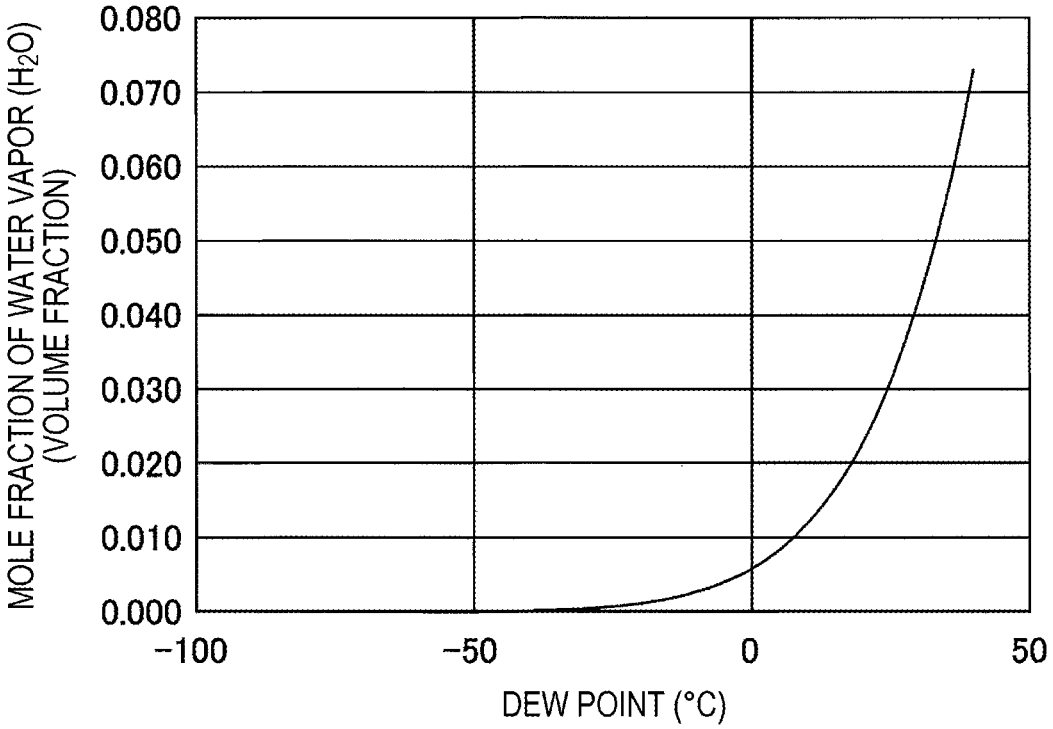
FIG. 4 is a graph illustrating the influence of the dew point on the mole fraction of water vapor.

Here, the amount of moisture M (g/min) contained in the humidified gas that is supplied into the soaking zone is calculated from the dew point of the introduced humidified gas by using the mole fraction (-) of water vapor contained in the humidified gas. Specifically, the dew point Th (° C.) of the humidified gas that is introduced into the soaking zone is converted to a saturated water vapor pressure and eventually to the mole fraction of water vapor ($H_2O$) by using the Tetens equation. This conversion equation is given below. In addition, FIG. 4 is a graph obtained from this equation, illustrating the influence of the dew point on the mole fraction of water vapor.

$$\text{mole fraction of } H_2O\,(-) = 6.11 \times 10^{(7.5 \times Th/(Th+237.3))}/1013.5 \qquad \text{(A)}$$

Moreover, from this mole fraction and the flow rate Vh ($Nm^3/hr$) of the humidified gas that is supplied, the above described amount of moisture M contained in the humidified gas that is supplied into the soaking zone is calculated by using Avogadro's law.

$$M\,(\text{g/min}) = \text{mole fraction of } H_2O \times Vh\,(Nm^3/hr)/60\,(\text{min/hr}) \times 18\,(\text{mass of 1 mol of } H_2O\text{: g/mol}) \times 1000\,(L/Nm^3)/22.4\,(\text{volume of 1 mol of gas: L/mol}) \qquad \text{(B)}$$

By substituting equation (A) into equation (B), equation (2) is obtained as follows.

$$M(\text{g/min}) = 0.08074 \times Vh \times 10^{7.5Th/(Th+237.3)} \qquad (2)$$

In the case where the humidified gas described above is supplied and the steel sheet passing conditions are stable with no change, it is preferable that the dew point of the interior of a region from the heating zone to the soaking zone be controlled to be −15° C. to 0° C.

Here, the reason why it is necessary for the humidified gas described above to satisfy expression (1) above is because it is necessary to supply water without excess or deficiency with respect to the surface area of the steel sheet existing in the annealing furnace.

In the case where M/X is 158 or less, since an insufficient amount of water is supplied with respect to the amount of water consumed on the surface of the steel sheet, surface concentration of Si is insufficiently inhibited, which results in bare spot occurrence.

In the case where M/X is 178 or more, since an excessive amount of water is supplied with respect to the amount of water consumed on the surface of the steel sheet, excessive oxidation of the steel sheet substrate occurs due to the excessive amount of water, which results in a pressing flaw defect, which is called pickup, occurring due to the oxides sticking to hearth rolls. Here, M is determined by using equation (2) with which the amount of moisture is calculated from the flow rate of the humidified gas and the dew point of the humidified gas. Similarly, X is determined by using equation (3) which expresses the influence of the surface area of the steel sheet existing in the annealing furnace and which has been derived by using a regression method from past operation results.

FIG. 1 is a schematic diagram illustrating the system supplying the gas mixture into the soaking zone 12. The humidified gas is supplied through upper humidified gas supply ports 36A, 36B, and 36C, middle humidified gas supply ports 37A, 37B, and 37C, and lower humidified gas supply ports 38A, 38B, and 38C, all of which are disposed in the region on the downstream side of the soaking zone, and through humidified gas supply ports 39A, 39B on the exit side of the soaking zone.

In FIG. 1, a portion of the reducing gas or the non-oxidizing gas (dry gas) described above is sent by a gas distributing device 24 to a humidifying device 26, and the remainder is sent to supply ports 42A, 42B, 42C, 44A, 44B, and 44C as a dry gas. The humidified gas is distributed by a gas distributing device 30 to various systems, and the humidified gas is sent through humidified gas pipework 34 and the humidified gas supply ports 36A, 36B, 36C, 37A, 37B, 37C, 38A, 38B, 38C, 39A, 39B into the soaking zone 12. The humidifying device may be disposed for each of the anterior and posterior gas supply systems. In particular, it is desirable that, in the region on the downstream side of the soaking zone where the steel sheet is heated to high temperature, a plurality of supply ports be arranged in the vertical direction.

Since there is a gas flow in which the dry gas which has been supplied into the cooling zone flows into the soaking zone and passes therethrough to the heating zone side, it is possible to provide humidification throughout the heating zone and the soaking zone by using the gas supplying method described above.

The dew point of the interior of the soaking zone is monitored by using dew point meters disposed at 46A, 46B, and 46C. 46A is a position at which the representative dew point on the downstream side of the soaking zone is monitored, 46B is a position at which the dew point in the vicinity of rolls in a lower part of the soaking zone is monitored, and 46C is a position at which the dew point of the gas flowing from the cooling zone 14 to the soaking zone is monitored.

In the case where the dew point of the whole soaking zone is increased to about 0° C., there is, particularly, an increase in time taken to decrease the dew point of the anterior part of the soaking zone when the steel grade is changed to one for which humidification is not necessary. Here, in the case where the dew point of the soaking zone is higher than 0° C., since a phenomenon which is called pickup and in which the oxides of the steel sheet stick to hearth rolls occurs, a pressing flaw-like defect occurs.

Although examples of the humidifying device include devices which humidify the dry gas by using a bubbling method, a membrane exchange method, a high-temperature steam addition method, or the like, it is preferable that a membrane exchange method be used form the viewpoint of the stability of the dew point when the flow rate is changed. In the humidifying device 26, there is a humidifying module having a fluorocarbon- or polyimide-based hollow fiber membrane or flat membrane, and the dry gas flows inside the membrane while pure water whose temperature is adjusted to a predetermined temperature by using a circulation thermostatic water tank 28 is circulated outside the membrane. The fluorocarbon- or polyimide-based hollow fiber membrane or flat membrane is a kind of ion-exchange membrane having an affinity for water molecules. When there is a difference in water concentration between the inside and the outside of the hollow fiber membrane, since a force to eliminate such a difference is generated, water permeates through the membrane to the side on which the water concentration is lower by using the generated force as a driving force. The temperature of the dry gas changes in accordance with seasonal and daily variations in atmospheric temperature. However, in this humidifying device, since it is also possible to perform heat exchange due to a sufficient contact area between the gas and the water with the water vapor-permeable membrane therebetween being achieved, the dry gas is humidified so as to become a gas having a dew point equal to the predetermined water temperature regardless of whether the temperature of the dry gas is lower or higher than the temperature of the circulated water, which makes it possible to control the dew point with high accuracy. It is possible to control the dew point of the humidified gas to any temperature in the range of 5° C. to 50° C. In the case where the dew point of the humidified gas is higher than the atmospheric temperature around the pipework, since dew condensation occurs, there may be a case where the dew condensation water directly enters the interior of the furnace. Therefore, the pipework for the humidified gas is heated and held at a temperature higher than or equal to the dew point of the humidified gas.

(Snout)

Gas nozzles are arranged over the entire perimeter of the inner wall of the snout, nitrogen gas or a nitrogen-hydrogen gas mixture is supplied through the gas nozzles downward along the inner wall, and at least two exhaust ports are disposed in an upper part of the snout to discharge the gas that is supplied through the gas nozzles described above. By discharging 70 volume % or more of the amount of the gas that is supplied through the gas nozzles, since it is possible to avoid ash deposition in the snout, it is possible to prevent an ash defect with more certainty.

The reason why the gas nozzles are arranged over the entire perimeter of the inner wall of the snout and nitrogen gas or a nitrogen-hydrogen gas mixture is supplied through the gas nozzles downward along the inner wall is because this makes it possible to efficiently send zinc vapor (or fine zinc powder) to the outside of the snout from the whole area of the liquid surface in the snout. In addition, the reason why nitrogen gas or a nitrogen-hydrogen gas mixture is supplied through the gas nozzles downward along the inner wall is because this makes it possible to prevent the oxidization of the liquid surface in the snout.

The reason why at least two exhaust ports are disposed in the upper part of the snout is because this makes it possible to efficiently discharge zinc vapor (or fine zinc powder) which is floating in the snout to the outside of the snout.

The reason why discharging 70 volume % or more of the amount of the gas that is supplied through the gas nozzles is effective is because this makes it possible to efficiently discharge zinc vapor (or fine zinc powder) which is floating in the snout to the outside of the snout without allowing the zinc vapor (or fine zinc powder) to remain in the snout. In the case where the amount of the discharged gas is less than 70 volume % of the amount of the gas that is supplied through the gas nozzles, since the zinc vapor (or fine zinc powder) is stuck and deposited on the inner wall of the snout or the like, the stuck and deposited substances drop onto the surface of the steel sheet or the liquid surface, which may result in poor surface appearance due to the substances sticking to the steel sheet.

Figure 2:
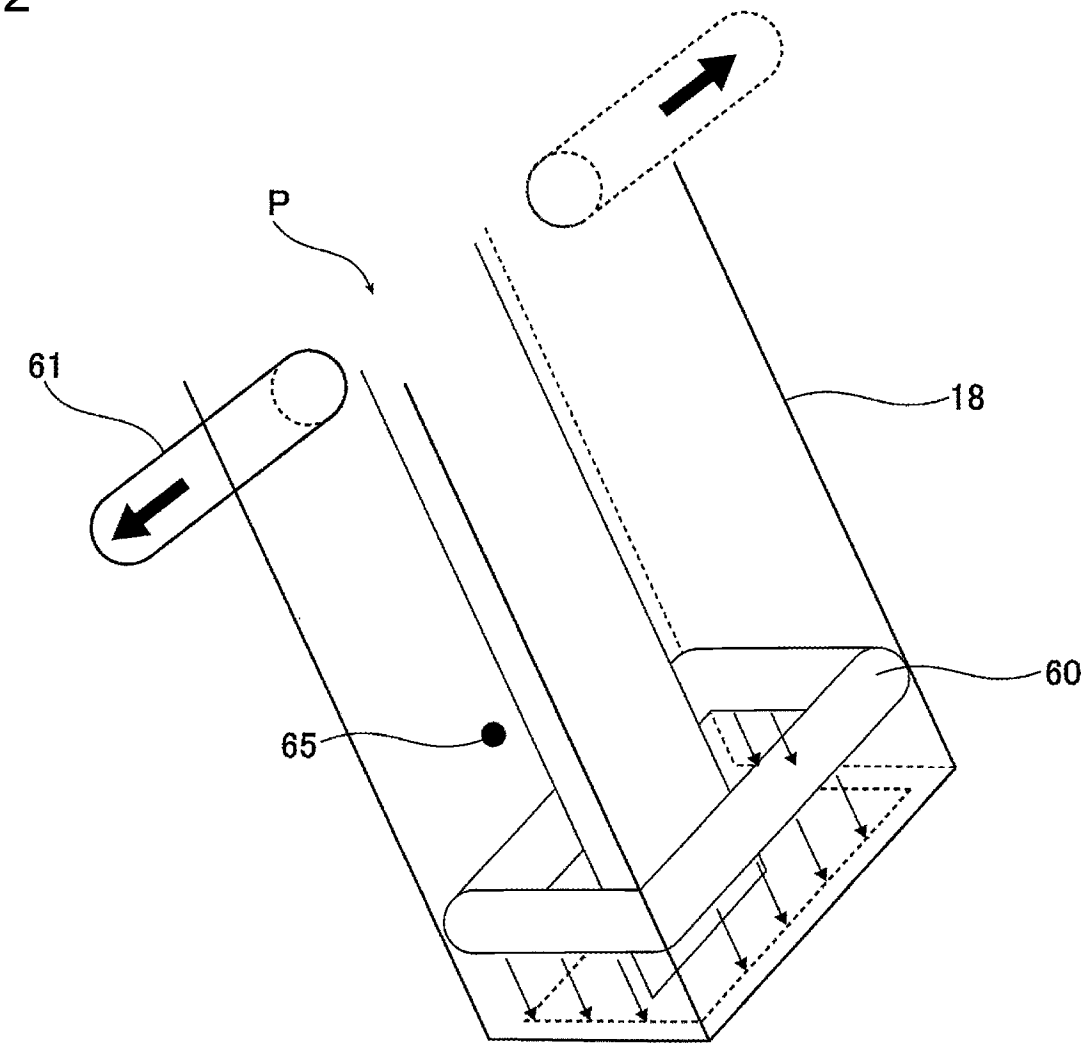
FIG. 2 is a diagram illustrating one embodiment of a snout structure and gas pipework.

FIG. 2 is a diagram illustrating the structure of the snout 18 and the gas flow. In the snout, gas nozzles 60 are arranged over the entire perimeter of the inner wall of the snout, and nitrogen gas or a nitrogen-hydrogen gas mixture is injected through the gas nozzles 60 downward along the inner wall of the snout. The expression "gas nozzles 60 are arranged over the entire perimeter of the inner wall of the snout" denotes a case where the gas nozzles 60 are arranged over the entire perimeter of the interior of the snout at a position where a plane perpendicular to the steel sheet in the snout intersects with the inner wall of the snout. The dew point of the atmosphere gas is measured by using a dew point meter which is disposed at a position 65 located above the gas nozzles 60, and the dew point is controlled to be −50° C. to −35° C. In the case where the dew point is more than −35° C., since the oxides of Zn and Al are formed on the liquid surface of the galvanizing bath, such oxides are entrained into the bath due to the steel sheet passing, which results in bare spots. On the other hand, in the case where the dew point is lower than −50° C., since zinc fume is markedly generated, it is difficult to control the amount of zinc fume by utilizing the gas flow rate through the gas nozzles, which results in a significant deterioration in the surface appearance of the product due to occurrence of ash defects.

Generally, since the temperature of the steel sheet is higher than the temperature of the atmosphere gas in the snout, updraft occurs in the vicinity of the steel sheet P. The gas injected through the gas nozzles 60 carries zinc fume and flows along the steel sheet to the upper part of the snout. The atmosphere gas in the snout containing zinc fume is discharged through exhaust ports 61 which are disposed in the upper part of the snout. At this time, by controlling the amount of gas which is discharged through the exhaust ports 61 to be 70% or more of the amount of the gas injected through the gas nozzles, since it is possible to avoid ash deposition in the snout, it is possible to prevent an ash defect from occurring with more certainty.

Figure 3:
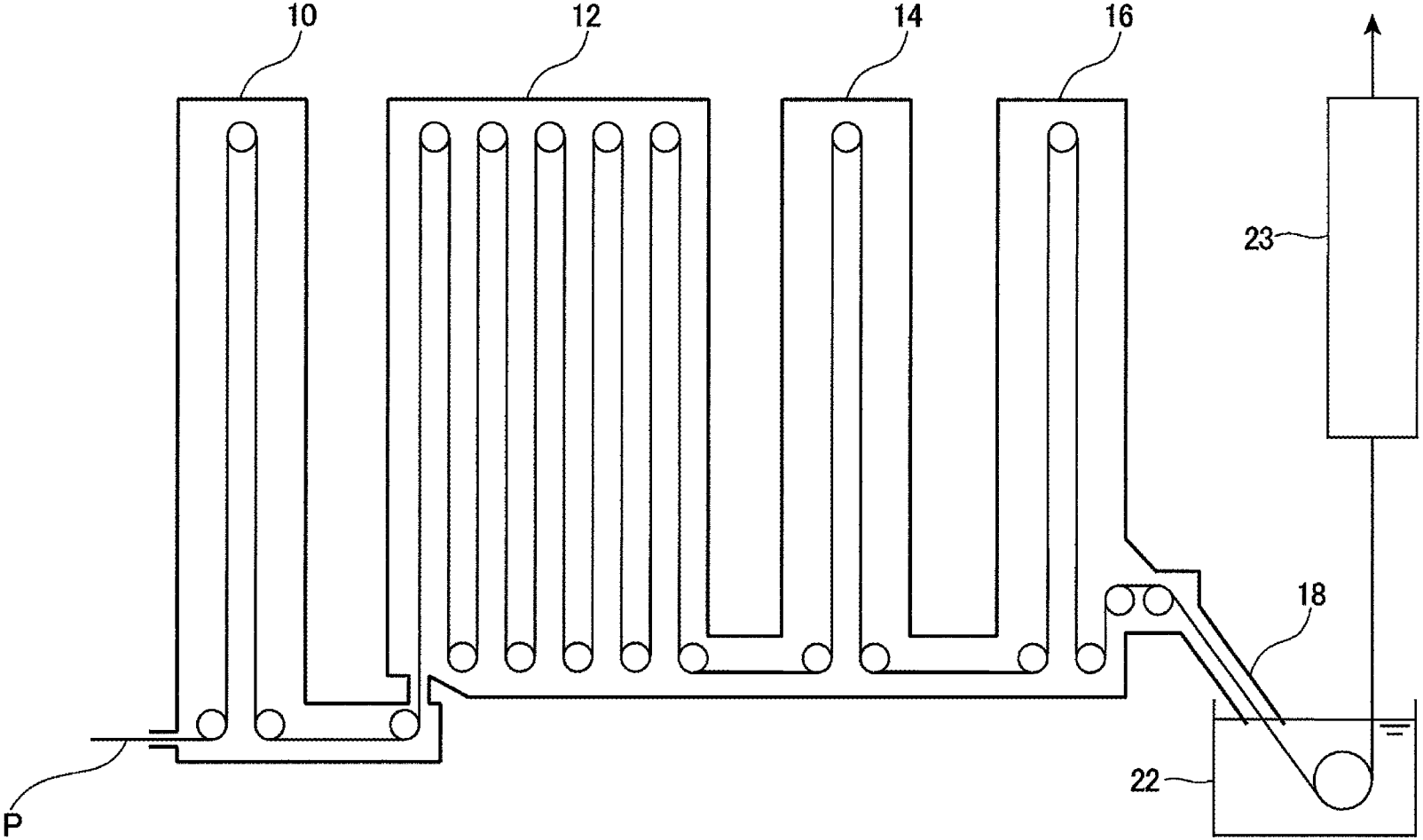
FIG. 3 is a diagram illustrating one example of the constitution of continuous hot-dip galvanizing apparatus including an annealing furnace and a coating equipment.

FIG. 3 is a diagram illustrating one example of the constitution of continuous hot-dip galvanizing apparatus including an annealing furnace and a coating equipment.

EXAMPLES

By using the continuous hot-dip galvanizing apparatus shown in FIG. 1 to FIG. 3, three kinds of steel sheets were annealed under various annealing conditions and thereafter subjected to a hot-dip galvanizing treatment and an alloying treatment. The main chemical compositions of steel sheets A to C are given in Table 1. The constituents other than the main chemical compositions given in Table 1 are optional constituents and a balance of Fe and incidental impurities.

TABLE 1

(mass %)

| Steel | Chemical Composition | | | | | Target Temperature in Soaking Zone |
|---|---|---|---|---|---|---|
| Code | C | Si | Mn | P | S | Exit Temperature (° C.) |
| A | 0.10 | 0.2 | 2.4 | 0.02 | 0.001 | 800 ± 15 |
| B | 0.10 | 0.9 | 2.8 | 0.01 | 0.001 | 850 ± 15 |
| C | 0.11 | 1.5 | 2.7 | 0.01 | 0.001 | 830 ± 15 |

balance: Fe and incidental impurities

The examples of the present invention were manufactured by using the humidifying system shown in FIG. 1. As the dry gas, a gas having a chemical composition containing hydrogen in an amount of 10 volume % and a balance of nitrogen and incidental impurities (having a dew point of −50° C.) was used. A portion of this dry gas was humidified by using a humidifying device having a humidifying unit of a hollow fiber membrane type to prepare a humidified gas. The humidifying unit of a hollow fiber membrane type was composed of 10 membrane modules, and the circulation water flowed at a flow rate of 20 L/min at maximum. The circulation thermostatic water tank was used in common, and with this, it was possible to supply pure water in an amount of 200 L/min in total. The humidified gas supply ports were disposed at positions shown in FIG. 1. The dry gas, which was not humidified, was supplied through the supply ports in the lower part of the furnace.

In the snout, the gas nozzles were arranged over the entire perimeter of the inner wall of the snout, nitrogen gas or a nitrogen-hydrogen gas mixture was supplied through the gas nozzles downward along the inner wall, and at least two exhaust ports were disposed in the upper part of the snout to discharge the atmosphere gas in the snout. 64 volume % to 92 volume % of the amount of the gas that was supplied through the gas nozzles was discharged, and the coating appearance was evaluated.

In the examples in which hot-dip galvannealed steel sheets (GA) were manufactured, the temperature of the galvanizing bath was 460° C., the Al concentration in the galvanizing bath was 0.130 mass %, and the coating weight was adjusted to be 50 g/m$^2$ per side by using a gas wiping method. In addition, after a hot-dip galvanizing treatment had been performed, an alloying treatment was performed by using an alloying furnace of an induction heating type so that the alloying degree (Fe content) of the coating film was 10 mass % to 13 mass %. The alloying temperature at this time is given in Table 2.

In the examples in which hot-dip galvanized steel sheets (GI) were manufactured, the temperature of the galvanizing bath was 450° C., the Al concentration in the galvanizing bath was 0.200 mass %, and the coating weight was adjusted to be 60 g/m$^2$ per side by using a gas wiping method.

(Evaluation Method)

To evaluate the coating appearance, a test utilizing an optical surface defect detector (for detecting a bare spot defect or a flaw due to roll pickup having a diameter of 0.5 mm or more) and evaluation grading of a variation in alloying by visual observation (in the case of GA) or evaluation grading of an appearance pattern by visual observation (in the case of GI) were performed. A case where all the items were good was denoted as ◎, a case where the result of the test utilizing the surface defect detector was satisfactory and there was a slight variation in alloying or a slight variation in appearance that caused no quality problem was denoted as o, a case where there was a variation in alloying or a variation in appearance that resulted in a decrease in surface quality grade was denoted as A, and a case where the result of the test utilizing the surface defect detector was unsatisfactory was denoted as x. The results are given in Table 2.

TABLE 2

| | | | | Soaking Zone to Connection Part | | | | | | | | Snout Nozzle |
|---|---|---|---|---|---|---|---|---|---|---|---|---|
| No | Steel Code | Sheet Width (m) | Sheet Passing Speed V (m/s) | Steel Sheet Temperature Measured at Exit (° C.) | Dry Gas Flow Rate (Nm$^3$/hr) | Humidified Gas Flow Rate (Nm$^3$/hr) | Humidified Gas Dew Point (° C.) | M | X | Expression (1) M/X | Conformity to Expression (1) | Gas Supply Flow Rate (Nm$^3$/hr) |
| 1 | A | 1.0 | 1.5 | 803 | 600 | 0 | — | — | — | — | no | 2.5 |
| 2 | A | 1.0 | 1.5 | 803 | 250 | 350 | 20 | 108.2 | 0.7935 | 136.3 | no | 2.5 |
| 3 | A | 1.0 | 1.5 | 805 | 250 | 420 | 20 | 129.8 | 0.7935 | 163.6 | yes | 2.5 |
| 4 | A | 1.0 | 1.5 | 800 | 250 | 450 | 20 | 139.1 | 0.7935 | 175.3 | yes | 2.5 |
| 5 | A | 1.0 | 1.5 | 801 | 250 | 500 | 20 | 154.5 | 0.7935 | 194.8 | no | 2.5 |
| 6 | A | 1.0 | 1.5 | 805 | 250 | 350 | 24 | 138.0 | 0.7935 | 174.0 | yes | 2.5 |
| 7 | B | 1.2 | 1.5 | 848 | 600 | 0 | — | — | 0.8535 | — | no | 2.5 |
| 8 | B | 1.2 | 1.5 | 850 | 250 | 450 | 20 | 139.1 | 0.8535 | 163.0 | yes | 2.5 |
| 9 | B | 1.2 | 1.5 | 852 | 250 | 450 | 20 | 139.1 | 0.8535 | 163.0 | yes | 2.5 |
| 10 | B | 1.2 | 1.5 | 851 | 250 | 450 | 20 | 139.1 | 0.8535 | 163.0 | yes | 2.5 |
| 11 | B | 1.2 | 1.5 | 850 | 250 | 450 | 20 | 139.1 | 0.8535 | 163.0 | yes | 2.5 |
| 12 | B | 1.2 | 1.5 | 853 | 250 | 450 | 20 | 139.1 | 0.8535 | 163.0 | yes | 2.5 |
| 13 | B | 1.2 | 1.5 | 848 | 250 | 450 | 20 | 139.1 | 0.8535 | 163.0 | yes | 2.5 |
| 14 | B | 1.2 | 1.5 | 847 | 250 | 450 | 20 | 139.1 | 0.8535 | 163.0 | yes | 2.5 |
| 15 | B | 1.2 | 1.5 | 845 | 250 | 450 | 20 | 139.1 | 0.8535 | 163.0 | yes | 2.5 |
| 16 | C | 0.9 | 1.2 | 829 | 600 | 0 | — | — | 0.7095 | — | no | 2.5 |
| 17 | C | 0.9 | 1.2 | 830 | 250 | 400 | 20 | 123.6 | 0.7095 | 174.3 | yes | 2.5 |
| 18 | C | 0.9 | 1.2 | 830 | 600 | 0 | — | — | 0.7095 | — | no | 2.5 |
| 19 | C | 0.9 | 1.2 | 832 | 250 | 400 | 20 | 123.6 | 0.7095 | 174.3 | yes | 2.5 |
| 20 | C | 0.9 | 1.2 | 832 | 250 | 410 | 20 | 126.7 | 0.7095 | 178.6 | no | 2.5 |
| 21 | C | 0.9 | 1.2 | 832 | 250 | 360 | 20 | 111.3 | 0.7095 | 156.8 | no | 2.5 |
| 22 | C | 0.9 | 1.2 | 832 | 250 | 370 | 20 | 114.4 | 0.7095 | 161.2 | yes | 2.5 |

| | Snout | | | Alloying Treatment | | | Material Strength | | |
|---|---|---|---|---|---|---|---|---|---|
| No | Atmosphere Dew Point (° C.) | Exhaust Flow Rate (Nm$^3$/hr) | Exhaust Flow Rate/Supply Flow Rate | GA/GI | Temperature Alloying (° C.) | Coating Appearance | Tensile Strength (MPa) | Comprehensive Evaluation Pass/Fail | Class |
| 1 | −44.3 | 2.3 | 0.92 | GA | 560 | x (Bare spot) | 740 | Fail | Comparative Example |
| 2 | −41.2 | 2.3 | 0.92 | GA | 540 | x (Bare spot) | 765 | Fail | Comparative Example |
| 3 | −45.5 | 2.3 | 0.92 | GA | 509 | ◎ | 798 | Pass | Example |

TABLE 2-continued

| | | | | | | | | | |
|---|---|---|---|---|---|---|---|---|---|
| 4 | −36.3 | 2.3 | 0.92 | GA | 506 | ◎ | 795 | Pass | Example |
| 5 | −48.1 | 2.3 | 0.92 | GA | 503 | x (Pickup) | 791 | Fail | Comparative Example |
| 6 | −41.2 | 2.3 | 0.92 | GA | 503 | ◎ | 798 | Pass | Example |
| 7 | −42.7 | 2.3 | 0.92 | GA | 564 | x (Bare spot) | 1022 | Fail | Comparative Example |
| 8 | −33.5 | 2.3 | 0.92 | GA | 510 | x (Bare spot) | 1195 | Fail | Comparative Example |
| 9 | −36.3 | 2.3 | 0.92 | GA | 512 | ◎ | 1203 | Pass | Example |
| 10 | −45.1 | 2.3 | 0.92 | GA | 509 | ◎ | 1201 | Pass | Example |
| 11 | −48.9 | 2.3 | 0.92 | GA | 510 | ○ (Slight Ash) | 1195 | Pass | Example |
| 12 | −51.2 | 2.3 | 0.92 | GA | 508 | x (Ash Defect) | 1205 | Fail | Comparative Example |
| 13 | −46.3 | 2.0 | 0.8 | GA | 510 | ◎ | 1033 | Pass | Example |
| 14 | −42.1 | 1.8 | 0.72 | GA | 513 | ◎ | 808 | Pass | Example |
| 15 | −38.7 | 1.6 | 0.64 | GA | 515 | ○ (Slight Ash) | 1203 | Pass | Example |
| 16 | −44.9 | 2.3 | 0.92 | GA | 498 | x (Bare spot) | 950 | Fail | Comparative Example |
| 17 | −42.1 | 2.3 | 0.92 | GA | 500 | ○ | 992 | Pass | Example |
| 18 | −42.1 | 2.3 | 0.92 | GI | N/A | x (Bare spot) | 995 | Fail | Comparative Example |
| 19 | −41.9 | 2.3 | 0.92 | GI | N/A | ○ | 998 | Pass | Example |
| 20 | −42.6 | 2.3 | 0.92 | GI | N/A | x (Pickup) | 1001 | Fail | Comparative Example |
| 21 | −43.5 | 2.3 | 0.92 | GI | N/A | x (Bare spot) | 995 | Fail | Comparative Example |
| 22 | −42.4 | 2.3 | 0.92 | GI | N/A | ○ | 1005 | Pass | Example |

In addition, the tensile strengths of GI and GA manufactured under the various conditions were measured. In the case of steel code A, which is a high-strength steel, a tensile strength of 780 MPa or higher was determined as satisfactory. In the case of steel code B, which is a high-strength steel, a tensile strength of 1180 MPa or higher was determined as satisfactory. In the case of steel code C, which is a high-strength steel, a tensile strength of 980 MPa or higher was determined as satisfactory. The results are given in Table 2.

As indicated in Table 2, it was clarified that the coating appearance was good and the desired tensile strength was also achieved in the case where M/X was within the range indicated in expression (1). On the other hand, in the case where M/X was out of the range indicated in expression (1), the coating appearance was poor and, in some cases, the desired tensile strength was also not achieved. In the case of No. 15 where the ratio of the amount of gas discharged from the snout to the amount of gas supplied through the gas nozzles into the snout was 64%, that is, less than 70%, although the appearance was within the acceptable range, slight ash deposition was observed. In the case of No. 11 where the dew point in the snout was −48.9° C., that is, close to the lower limit (−50° C.), although the appearance was within the acceptable range, slight ash deposition was observed.

INDUSTRIAL APPLICABILITY

According to the method for manufacturing a hot-dip galvanized steel sheet according to aspects of the present invention, it is possible to achieve high coating adhesiveness and good coating appearance, even in the case where a hot-dip galvanizing treatment is performed on a steel sheet containing Si in an amount of 0.2 mass % or more, and it is possible to inhibit a decrease in tensile strength as a result of decreasing the alloying temperature even in the case where an alloying treatment is performed after a hot-dip galvanizing treatment has been performed. In addition, even in the case where an ordinary steel sheet and a high-strength steel sheet are manufactured continuously, it is possible to avoid operation problems such as pickup or the like.

REFERENCE SIGNS LIST

P steel sheet
10 heating zone
12 soaking zone
14 first cooling zone (rapid cooling zone)
16 second cooling zone (gradual cooling zone)
18 snout
22 hot-dip galvanizing bath
23 alloying equipment
24 gas distributing device
26 humidifying device
28 circulation thermostatic water tank
30 humidified gas distributing device
32 humidified gas flow rate meter
33 humidified gas dew point meter
34 humidified gas pipework
36A, 36B, 36C humidified gas supply port
37A, 37B, 37C humidified gas supply port
38A, 38B, 38C humidified gas supply port
39A, 39B humidified gas supply port
42A, 42B, 42C dry gas supply port
44A, 44B, 44C dry gas supply port
46A, 46B, 46C dew point measuring position in soaking zone
60 supply gas nozzle in snout
61 exhaust port in upper part of snout
65 dew point measuring position in snout

The invention claimed is:

1. A method for manufacturing a hot-dip galvanized steel sheet, the method comprising performing a hot-dip galvanizing treatment on a steel sheet containing Si in an amount of 0.2 mass % or more by using a continuous hot-dip galvanizing apparatus including an annealing furnace in which a heating zone, a soaking zone, and a cooling zone are arranged in this order, a snout adjacent to the cooling zone, and hot-dip galvanizing equipment, wherein a humidified nitrogen-hydrogen gas mixture containing moisture in such a manner that expression (1) below is satisfied is supplied into a region on the downstream side of the soaking zone, wherein gas nozzles are arranged over the entire perimeter of an inner wall of the snout, wherein nitrogen gas or a nitrogen-hydrogen gas mixture is supplied through the gas nozzles downward along the inner wall, wherein at least two exhaust ports are disposed in an upper part of the snout to discharge the gas that is supplied through the gas nozzles, and wherein the dew point in the snout is controlled to be −50° C. to −35° C.:

$$158 < M/X < 178, \quad (1)$$

where M denotes the amount of moisture contained in the humidified gas that is supplied into the soaking zone and X denotes a parameter regarding an influence on of a surface area of the steel sheet wherein M and X are calculated by the following equations below:

$$M = 0.08074 \times Vh \times 10^{7.5Th/(Th+237.3)}$$

$$X = 0.2 \times w \times S + 0.4935$$

Vh: flow rate of the humidified gas that is supplied into the soaking zone (Nm3/hr)

Th: dew point of the humidified gas that is supplied into the soaking zone (° C.)

w: width of the steel sheet (m)

S: sheet passing speed (m/s).

2. The method for manufacturing a hot-dip galvanized steel sheet according to claim 1, wherein 70 volume % or more of the amount of the gas that is supplied through the gas nozzles is discharged through the exhaust ports in the upper part of the snout.

* * * * *